US011096508B1

(12) United States Patent
Lawton

(10) Patent No.: US 11,096,508 B1
(45) Date of Patent: Aug. 24, 2021

(54) FRAME ASSEMBLY AND METHODS OF MAKING AND USING THE SAME

(71) Applicant: Daniel Wayne Lawton, Calabash, NC (US)

(72) Inventor: Daniel Wayne Lawton, Calabash, NC (US)

( * ) Notice: Subject to any disclaimer, the term of this patent is extended or adjusted under 35 U.S.C. 154(b) by 0 days.

(21) Appl. No.: 17/135,495

(22) Filed: Dec. 28, 2020

(51) Int. Cl.
*A47G 1/06* (2006.01)

(52) U.S. Cl.
CPC ..... *A47G 1/06* (2013.01); *A47G 2001/0661* (2013.01); *A47G 2001/0677* (2013.01)

(58) Field of Classification Search
CPC ..... A47G 2001/0677; A47G 1/06; A47G 2001/0661; G09F 1/12
See application file for complete search history.

(56) References Cited

U.S. PATENT DOCUMENTS 1,210,226 A * 12/1916 Aeb ..... A47G 1/0605 40/792
1,246,095 A 11/1917 Herrmann
1,904,318 A * 4/1933 Lehere ..... G09F 1/12 40/791
4,216,597 A 8/1980 Kocina et al.
4,282,668 A 8/1981 Jolkovski
4,348,826 A * 9/1982 Reim ..... A47G 1/10 40/782
4,368,584 A * 1/1983 Logan ..... A47G 1/1666 40/785
4,704,814 A 11/1987 Astolfi
4,805,325 A 2/1989 Cassard
5,974,714 A * 11/1999 Jones ..... A47G 1/0605 40/768
7,100,317 B1 * 9/2006 Strong ..... A47G 1/141 40/124.07
7,240,447 B2 7/2007 Humphrey
2007/0051023 A1 3/2007 Bravo
2010/0005695 A1 * 1/2010 Huang ..... F16F 1/027 40/792

OTHER PUBLICATIONS

Definition of the term ring taken from www.merriam-webster.com; accessed Jan. 25, 2021.*

* cited by examiner

*Primary Examiner* — Christopher Garft
(74) *Attorney, Agent, or Firm* — Dogwood Patent and Trademark Law; Ashley D. Johnson

(57) ABSTRACT

The presently disclosed subject matter is generally directed to a frame assembly that easily and efficiently allows a user to insert and/or remove an item from the frame. Specifically, the assembly comprises a generally rectangular support formed by one or more interconnected sidewalls that extend about the periphery of a central opening. The central opening is sized and shaped to fit any of a wide variety of display items (e.g., artwork, photographs, diplomas). The rear face of the assembly includes a plurality of rings. Each ring is flexible, allowing a displayed item to be easily and efficiently inserted and removed from the frame. The rings also function to retain the displayed item within the frame.

20 Claims, 11 Drawing Sheets

FRAME ASSEMBLY AND METHODS OF MAKING AND USING THE SAME

TECHNICAL FIELD

The presently disclosed subject matter is generally directed to an improved frame assembly, and to methods of making and using the disclosed frame assembly.

BACKGROUND

Frames for surrounding and protecting artwork, diplomas, posters, photographs, and other similar items are well known in the art. The essential elements of standard frames include an outer frame support, a transparent front member (e.g., glass), and a backing board mounted to the frame support to retain the displayed item under the transparent member. Conventional frames typically retain displayed items within the frame using brads or small nails that are driven into the back surface of the frame. Alternatively, the frames can include rear metal tabs for securing content within the frame interior. These conventional frames are not designed for easy assembly or disassembly, such as to change the displayed item. For example, when a user desires to replace the display items, the brads or nails must be removed and reapplied after the new content has been added. However, removing and adding brads or nails is tedious and often leads to bent hardware. In addition, the user can become injured if the hammer accidentally strikes a thumb or finger. For frames with rear metal tabs, the tabs are bent up and away from the frame backing board during removal. After the new content is inserted, the tabs are bent downwardly against the backing board to secure the content within the frame. The frame metal tabs are designed to survive only a few changes and can easily become damaged or break off, rendering the frame unusable. The metal tabs also vary in quality, often containing sharp edges that can cut the user or the display item during assembly and disassembly. Therefore, the conventional operations of inserting, securing, and replacing the content in a frame are time consuming, cumbersome, and are not easily achieved. As such, it would be beneficial to provide an improved frame assembly that allows for quick and easy addition and removal of display items from the frame.

SUMMARY

In some embodiments, the presently disclosed subject matter is directed to a framing assembly. Specifically, the framing assembly comprises a support defined by a front face, an opposed rear face, and one or more sidewalls joined together to form a support body defined by a central opening. The rear face comprises one or more grooves. The assembly also includes one or more flexible rings, wherein each ring is sized and shaped to be partially housed within a corresponding groove. When each ring is partially housed within the corresponding groove, a ring overhang extends adjacent to the central opening.

In some embodiments, the frame assembly further includes a transparent sheet, a rear backing, a matting, or combinations thereof.

In some embodiments, about 20-95 percent of each ring (e.g., the total volume of each ring) is housed within a corresponding groove.

In some embodiments, the rings are circular, oval, square, triangular, hexagonal, pentagonal, octagonal, abstract, or combinations thereof.

In some embodiments, the grooves have a depth of about 0.01-0.5 inches.

In some embodiments, the depth of each groove is greater than or about equal to the height of a corresponding ring.

In some embodiments, the frame assembly about 1-10 grooves and about 1-10 rings.

In some embodiments, the support has a length, width, or both of about 4-50 inches.

In some embodiments, the frame assembly further includes an interior flange positioned about the perimeter of the central opening.

In some embodiments, the rings are constructed from rubber, plastic, or combinations thereof.

In some embodiments, the support is constructed from wood, plastic, metal, stone, ceramic, or combinations thereof.

In some embodiments, the presently disclosed subject matter is directed to a method of inserting or removing a display item into or from a frame assembly. Specifically, the method comprises positioning the display item adjacent to the rear face of the frame assembly support such that the display item abuts the ring overhangs in a first position. The frame assembly comprises a support defined by a front face, an opposed rear face, and one or more sidewalls joined together to form a support body defined by a central opening. The rear face comprises one or more grooves. The assembly includes one or more flexible rings, wherein each ring is sized and shaped to be partially housed within a corresponding groove. When each ring is partially housed within the corresponding groove, a ring overhang extends adjacent to the central opening. The method includes positioning one or more edges of the display item (i.e., top edge, bottom edge, left side edge, and/or right side edge) between a plurality of rings and the front face of the frame assembly. The remainder of the rings (i.e., those rings that are not positioned next to the one or more edges of the display them) are then rolled past the display item, toward the rear face of the frame assembly to seat the display item between the front and rear faces of the support, whereby the display item is inserted into the frame assembly.

To remove the display item from the frame assembly, light pressure is applied to the face of the display item, pushing directly towards the rear face of the frame assembly until the display assembly is separated from the frame assembly.

In some embodiments, the rings bend about 45-90 degrees from the first position to the second position (i.e., at least/no more than about 45, 50, 55, 60, 65, 70, 75, 80, 85, or 90 degrees).

In some embodiments, the method further includes adding or removing a backing, matting, transparent sheet, or combinations thereof.

In some embodiments, the display item rests against a frame flange after being inserted into the frame assembly.

In some embodiments, the display item is selected from an art print, art canvas, drawing, print, poster, photograph, card, diploma, mirror, certificate, tapestry, or combinations thereof.

DETAILED DESCRIPTION

Figure 1:
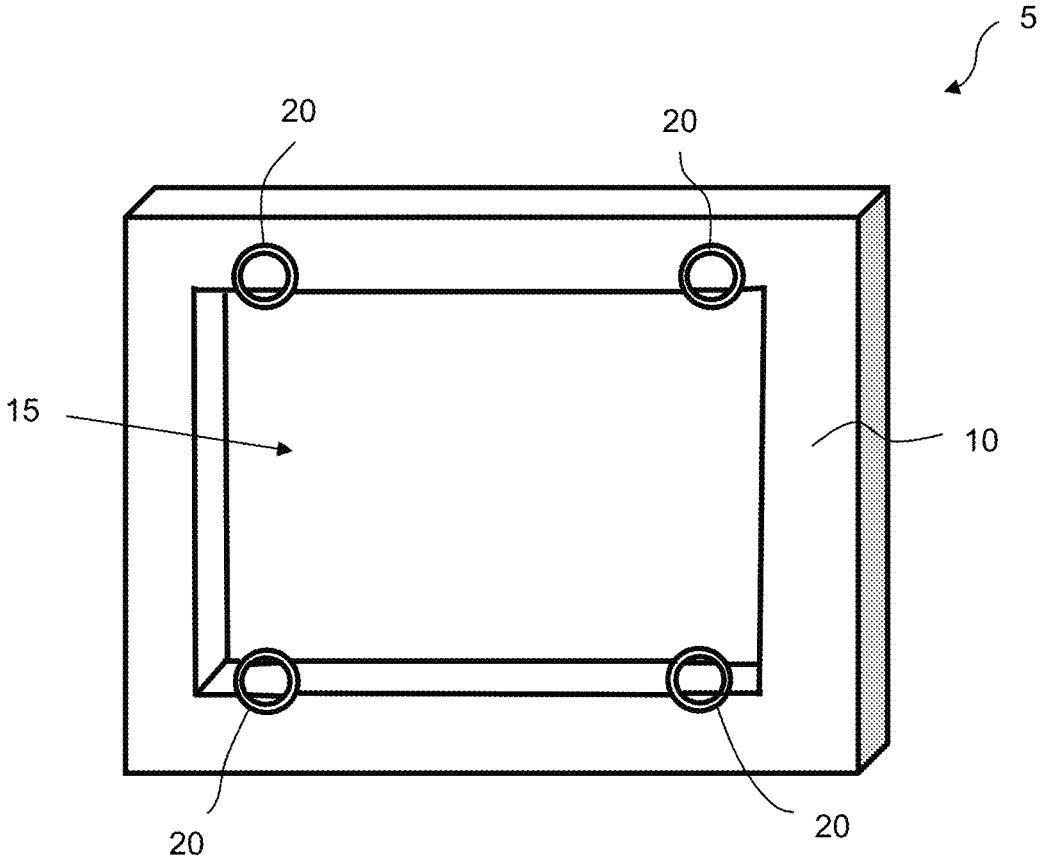
FIG. 1 is a perspective view of a frame assembly in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a frame assembly that easily and efficiently allows a user to insert and/or remove an item from the frame. FIG. 1 illustrates one embodiment of assembly 5 comprising generally rectangular support 10 formed by one or more interconnected sidewalls that extend about the periphery of central opening 15. The central opening is sized and shaped to fit any of a wide variety of display items (e.g., artwork, photographs, diplomas). The rear face of the assembly includes a plurality of rings 20. Each ring is flexible, allowing a displayed item to be easily and efficiently inserted and removed from the frame, as described in more detail below. The rings also function to retain the displayed item within the frame. The disclosed frame assembly therefore provides for a quick and easy one-step insertion or removal of the displayed item from the frame.

The term "display" or "displayed item" as used herein refers to any item that can be held within frame assembly 5. For example, the display item can include artwork (prints, paintings, drawings, canvases), photographs, cards, diplomas, mirrors, certificates, tapestries, calendars, and the like.

Figure 2A:
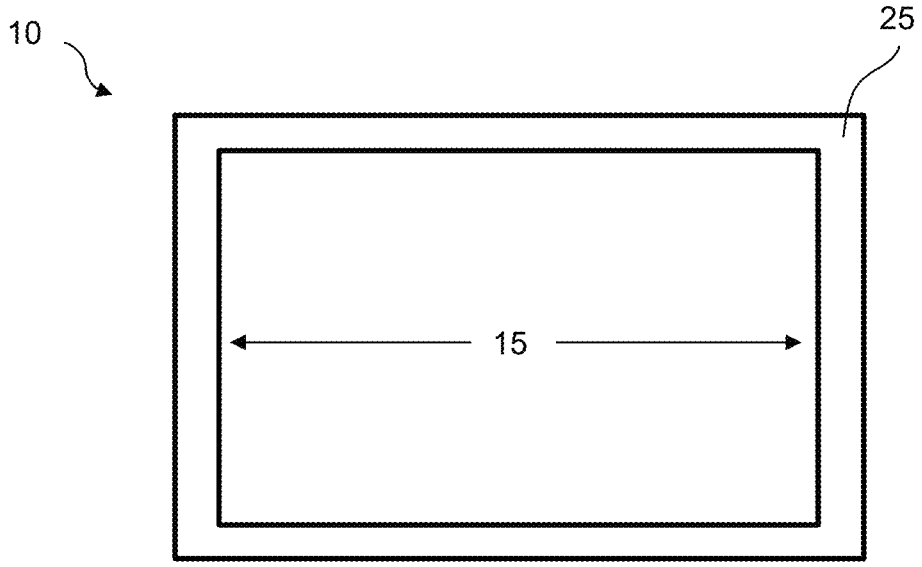
FIG. 2*a* is a top plan view of a frame assembly support in accordance with some embodiments of the presently disclosed subject matter.
Figure 2B:
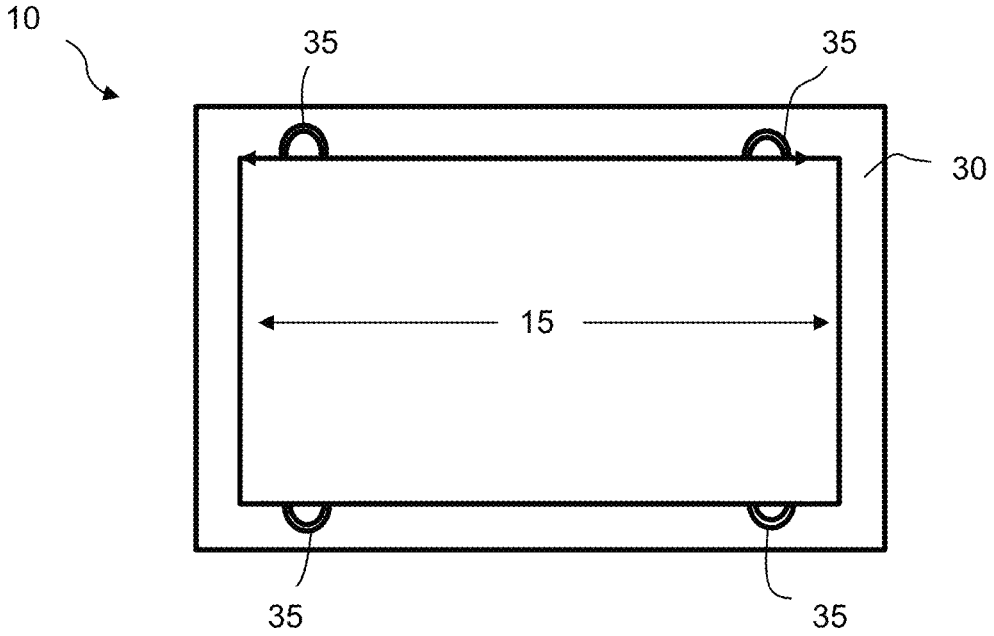
FIG. 2*b* is a bottom plan view of a frame assembly support in accordance with some embodiments of the presently disclosed subject matter.

FIGS. 2*a* and 2*b* illustrate top and bottom views of support 10, respectively. As shown, FIG. 2*a* illustrates top support face 25 which can be the face of the assembly viewed when hung on a wall or displayed. Top face 25 can therefore be positioned on the same plane as the display item framed by the assembly.

Figure 3A:
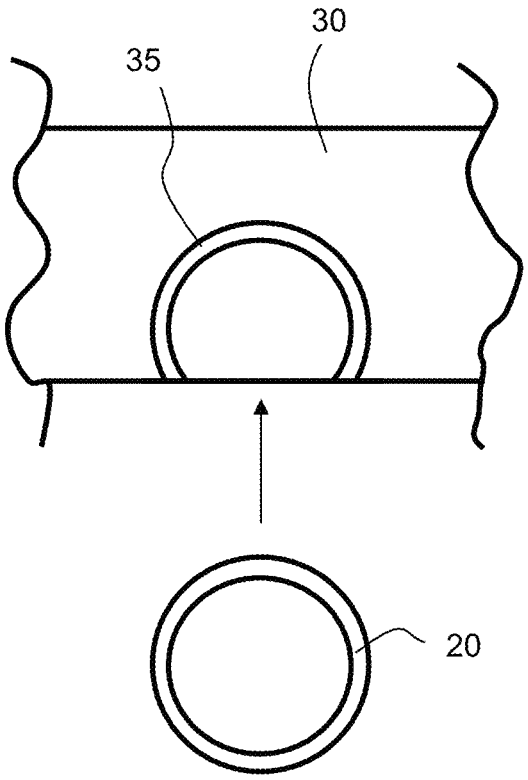
FIGS. 3*a* and 3*b* are bottom plan views illustrating one method of inserting a ring into a frame support groove in accordance with some embodiments of the presently disclosed subject matter.
Figure 3B:
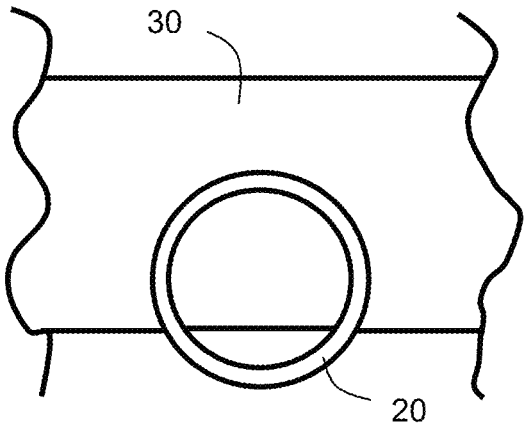

FIG. 2*b* illustrates opposing rear face 30 positioned on the back side of the assembly, away from the view of the user when the assembly is in use (e.g., opposing the display side). As illustrated, the support rear face includes a series of grooves 35. The term "groove" refers to any recess within the rear face of the support. The grooves are sized and shaped to house rings 20. Each groove is configured in a shape to be consistent with the shape of at least a portion of a corresponding ring 20. Thus, if ring 20 has a circular shape, the groove can have a semi-circular shape to allow a portion of the ring to extend into the groove, as shown in FIGS. 3*a* and 3*b*. In some embodiments, about 20-95% of the total volume of the ring is housed within groove 35 (e.g., at least/no more than about 20, 25, 30, 35, 40, 45, 50, 55, 60, 65, 70, 75, 80, 85, 90, or 95%).

Although the rings and grooves are shown as being circular in the Figures, it should be appreciated that they can have any desired shape (e.g., square, rectangular, oval, triangular, abstract, and the like).

Grooves 35 can be configured in any desired depth, such as about 0.01 inches to about 0.5 inches (e.g., at least/no more than about 0.01, 0.1, 0.2, 0.3, 0.4, or 0.5 inches). It should be appreciated that the groove depth is not limited and be greater or less than the range given above. In some embodiments, the grooves are constructed such that when a corresponding ring 20 is inserted into the groove, the ring is flush with the rear support surface. In other words, the depth of groove 35 can be about the same or greater than the height of ring 20. In this way, the assembly can lie flat against the wall or a support layer without interference from the ring.

Rear support surface 30 can include any desired number of grooves, such as about 1-10. Thus, the support can include at least/no more than about 1, 2, 3, 4, 5, 6, 7, 8, 9, or 10 grooves.

Grooves 35 can be formed using any known method. For example, the grooves can be formed in the support by thermoforming, laser cutting, the use of a sharp utensil (e.g., knife), and the like.

Figure 4:
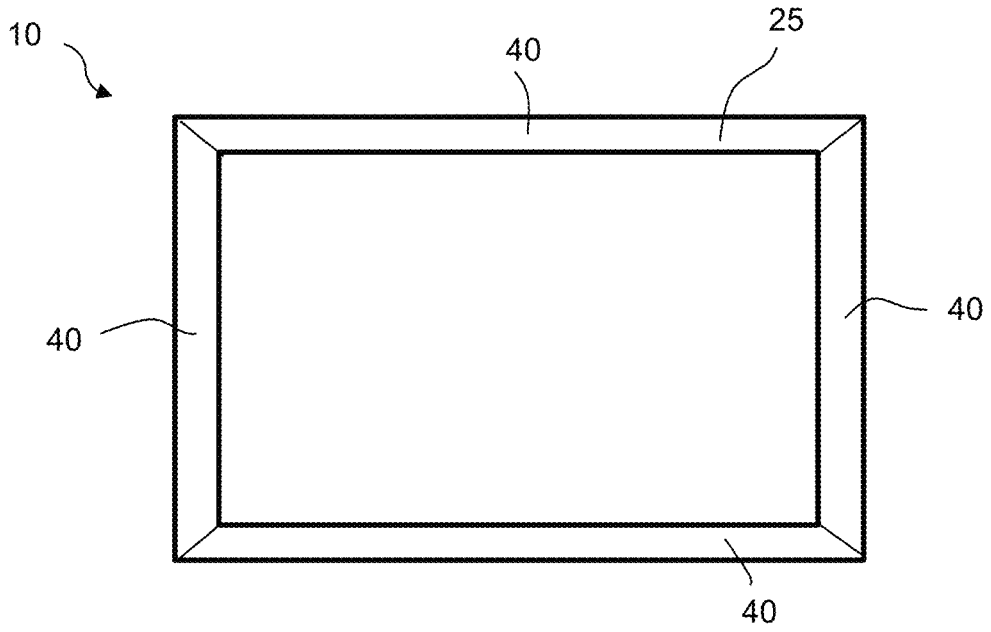
FIG. 4 is a top plan view of a frame assembly support comprising a plurality of sidewalls in accordance with some embodiments of the presently disclosed subject matter.

The support can optionally include one or more sidewalls 40 that join together to form the support, as illustrated in FIG. 4. For example, the support can include 4 sidewalls that join together using conventional mechanisms (e.g., adhesive, staples, pins, screws, fasteners, welding). Alternatively, support 10 can be constructed as a single, unitary member using known methods (e.g., thermoforming, laser cutting, and the like).

Although depicted as rectangular in the figures, support 10 can have any desired shape, such as (but not limited to) square, oval, circular, triangular, heart-shaped, abstract, and the like.

Figure 5A:
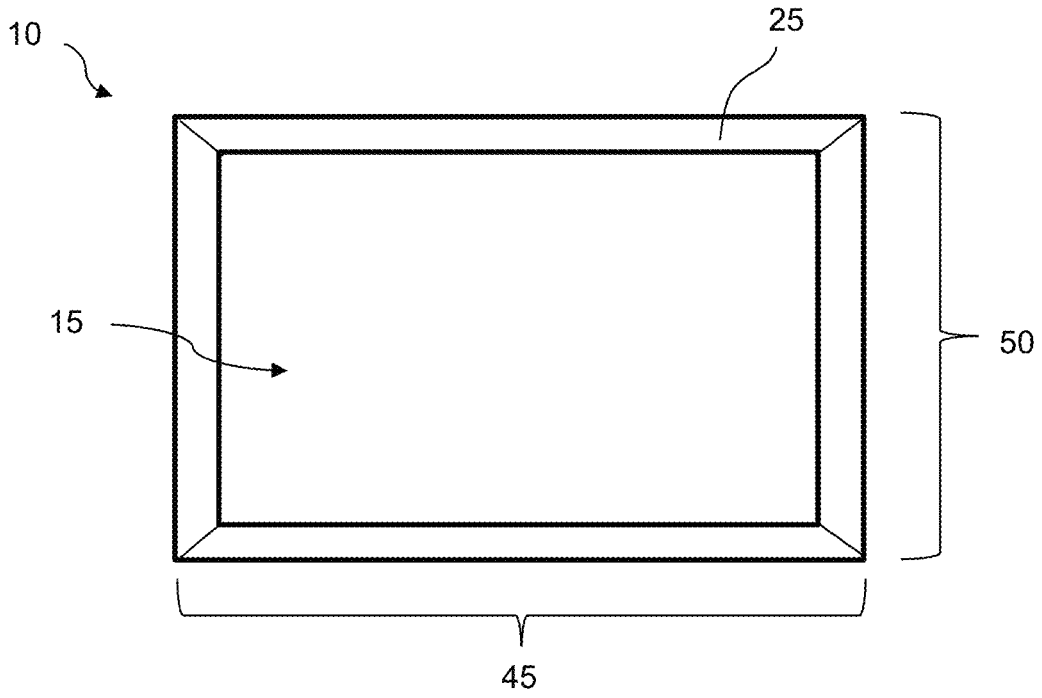
FIG. 5*a* is a top plan view of a frame assembly support illustrating the support length and width in accordance with some embodiments of the presently disclosed subject matter.

As shown in FIG. 5*a*, the support can have length 45 and width 50. In some embodiments, the term "length" refers to the longest horizontal distance of the support. The term "width" refers to the longest vertical distance of the support. The support can be configured in a wide variety of sizes to accommodate different sized inserts. For example, the support can have a length of about 5-50 inches (e.g., at least/no more than about 5, 10, 15, 20, 25, 30, 35, 40, 45, or 50 inches). Similarly, the support can have a width of about 5-50 inches (e.g., at least/no more than about 5, 10, 15, 20, 25, 30, 35, 40, 45, or 50 inches). However, it should be appreciated that the support length and width are not limited and can be greater or less than the ranges given herein.

As set forth above, the support also includes central opening 15. The central opening can have any desired shape. For example, the central opening can have about the same shape as the external circumferential shape of the support. However, the presently disclosed subject matter is not limited and the central opening can have a shape that differs from the external perimeter shape of frame 10.

Figure 5B:
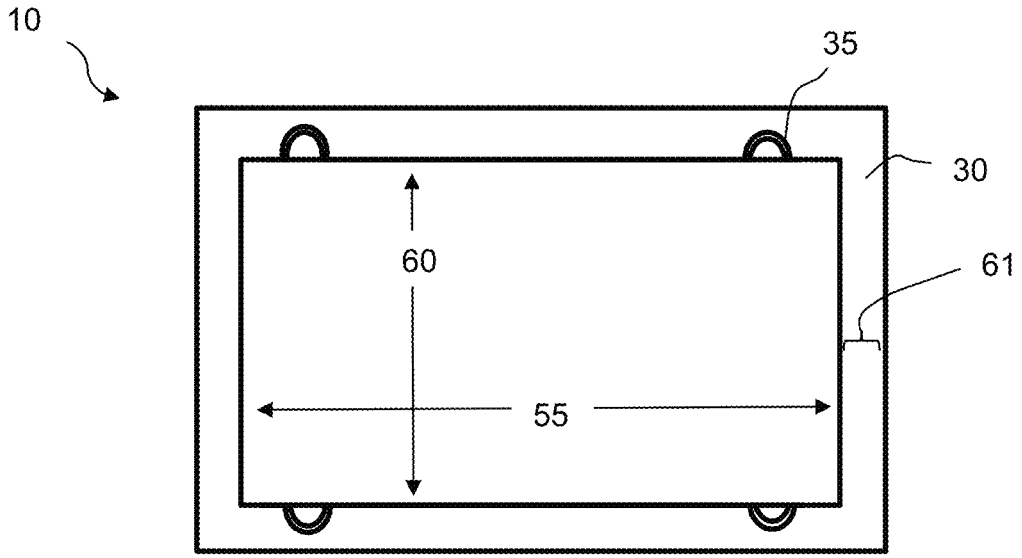
FIG. 5*b* is a bottom plan view of a frame assembly support illustrating the support opening length and width in accordance with some embodiments of the presently disclosed subject matter.

As illustrated in FIG. 5*b*, central opening 15 can have length 55 and/or width 60 of about 4-50 inches (e.g., at least/no more than about 4, 5, 10, 15, 20, 25, 30, 35, 40, 45, or 50 inches). However, the central opening is not limited and can be configured outside the range given above.

Thus, span 61 of the support can be about 0.5-10 inches. The term "span" refers to the distance between the outer circumference of the frame support and the inner circumference of the frame support, as shown in FIG. 5*b*.

It should be appreciated that the dimensions of the support frame and central opening can be provided in various sizes and shapes, depending at least in part on the size and shape of the display item (e.g., 3.5"×3.5", 4"×6", 8"×10", 11"×17", etc.).

Figure 6A:
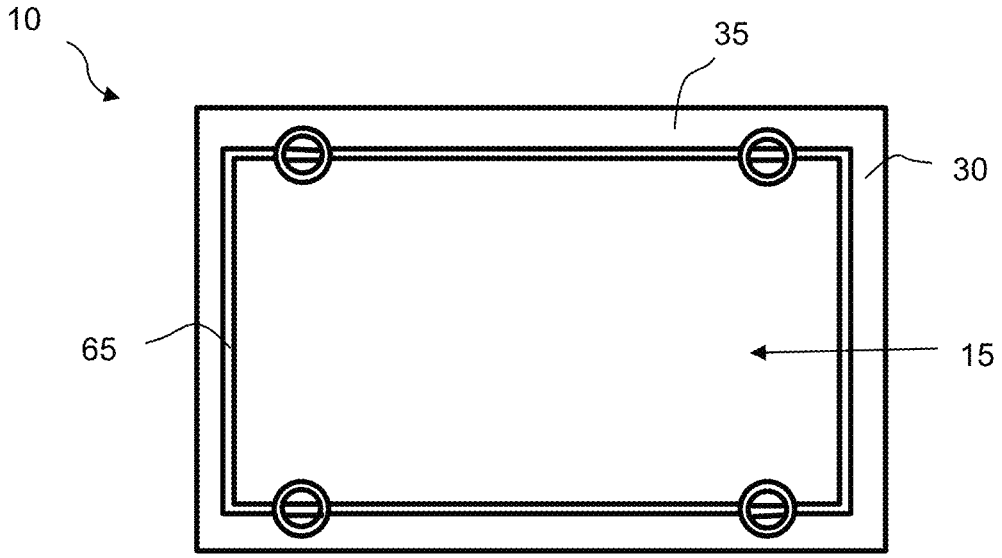
FIG. 6*a* is a bottom plan view of a frame assembly comprising a flange in accordance with some embodiments of the presently disclosed subject matter.

In some embodiments, support 10 can include flange 65 positioned about the perimeter of opening 15, as shown in FIG. 6*a*. The flange can retain the display item, matting, and/or a transparent sheet (e.g., glass), acting as shelf or support. The flange can have any desired thickness, such as about 0.1-1 inches (e.g., 0.1, 0.2, 0.3, 0.4, 0.5, 0.6, 0.7, 0.8, 0.9 or 1 inch). However, the flange thickness can be greater or less than the range given herein.

Figure 6B:
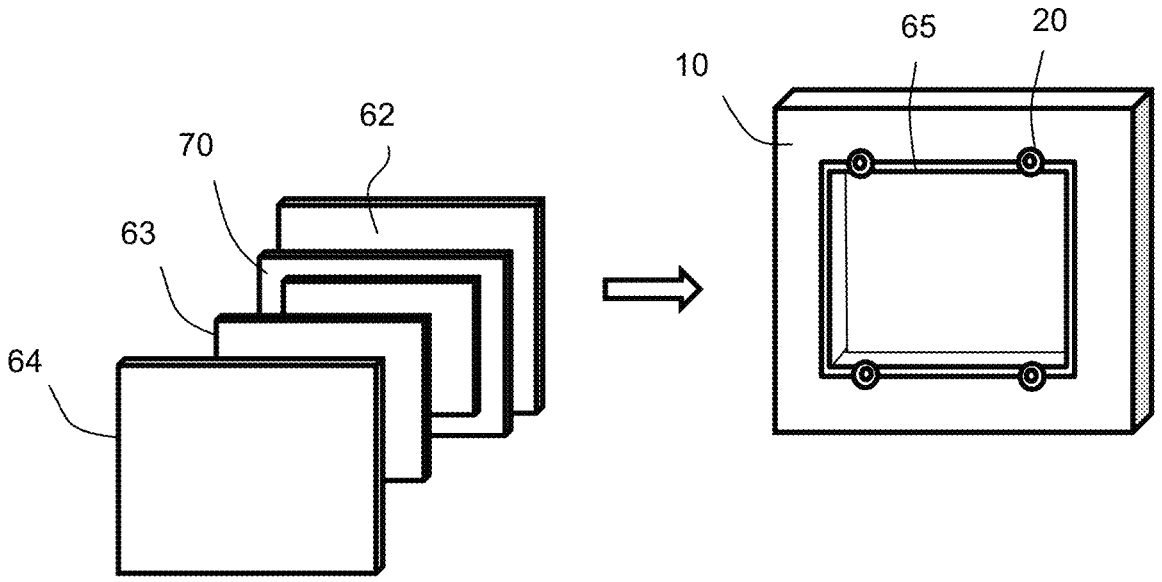
FIG. 6*b* is a perspective view illustrating one method of inserting various components into a frame assembly in accordance with some embodiments of the presently disclosed subject matter.

Thus, the disclosed assembly can optionally include transparent sheet 62 to provide a layer of protection to display item 63. The display item can be positioned between the transparent sheet and optional backing material 64 or the rings, as shown in FIG. 6*b*. The transparent sheet can include any transparent material, including (but not limited to) Plexiglass®, plastic, vinyl, acrylic, polymer, safety glass, or combinations thereof. Transparent sheet 62 allows the display item to be viewed, but provides a layer of protection from dust, dirt, fingerprints, and the like.

Optional backing 64 can include any rigid or semi-rigid material to provide stability to the display item and assist in maintaining it in a desired position. Suitable materials can include (but are not limited to) cardboard, metal, plastic, and the like.

Some users also include matting 70 in their frames. The matting can provide a clean border and thus emphasize display item 63. In some embodiments, multiple matting sheets can be used in different colors. The matting is typically configured between the display item and the transparent sheet. It should be appreciated that matting is an optional feature.

Figure 6C:
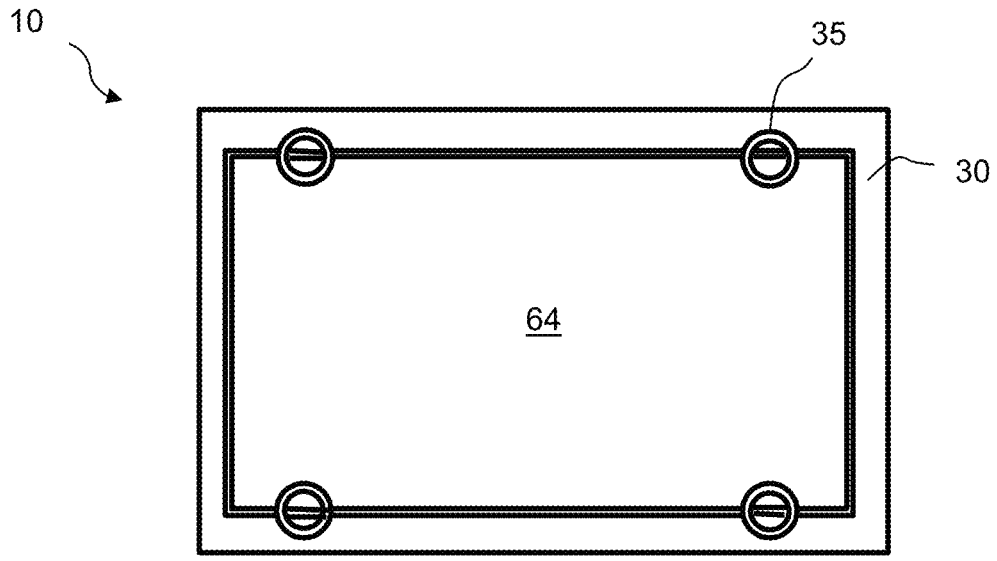
FIG. 6*c* is a bottom plan view of a frame assembly comprising a rear backing in accordance with some embodiments of the presently disclosed subject matter.

The flange therefore allows backing 64, matting 70, transparent sheet 62, and/or display item 63 to be retained against the opening as shown in FIG. 6*c*. It should be appreciated that the transparent sheet, backing, and matting are all optional, and in some embodiments the display item is directly positioned within the central opening of the frame support. It should further be appreciated that the backing, matting, and transparent sheet can be used in embodiments of the frame that lack flange 65.

Figure 7:
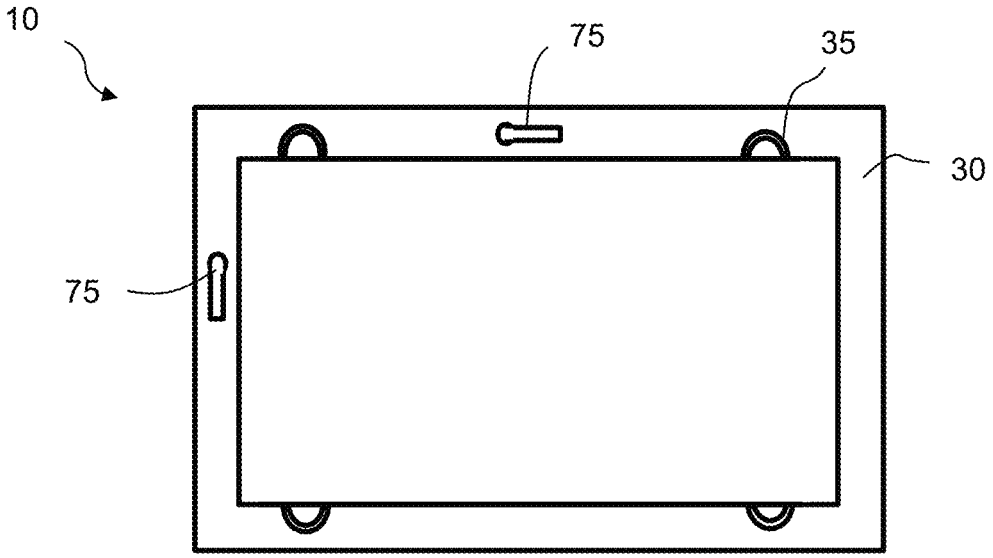
FIG. 7 is a bottom plan view of a frame support comprising a plurality of hanging apertures in accordance with some embodiments of the presently disclosed subject matter.

The rear face of the support can optionally include one or more hanging apertures that allow the assembly to be hung, if desired by the user. FIG. 7 illustrates one embodiment of hanging aperture 75. The aperture can be centrally located and/or spaced along one portion of the support to prevent or reduce the likelihood of uneven hanging. In addition to or in place of aperture 75, the assembly can include any elements that allow the assembly to be hung.

Support 10 can be constructed from any of a wide variety of materials. For example, the support can be constructed from wood (e.g., bamboo, oak, pine, mahogany, cedar, maple, etc.), stone, plastic, metal (e.g., copper, stainless steel), ceramics, or combinations thereof. It should be appreciated that any material can be used.

Figure 8A:
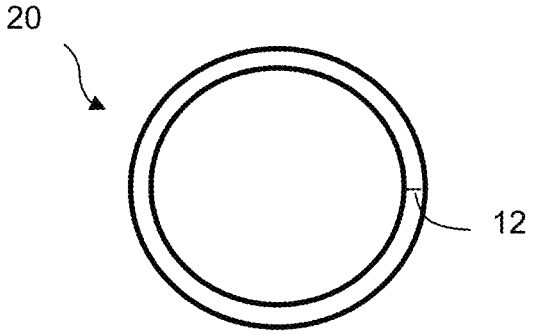
FIG. 8*a* is a top plan view of a ring in accordance with some embodiments of the presently disclosed subject matter.
Figure 8B:
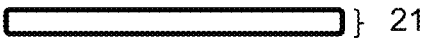
FIG. 8*b* is a side plan view of a ring in accordance with some embodiments of the presently disclosed subject matter.

FIGS. 8*a* and 8*b* illustrate one embodiment of ring 20 that is sized and shaped to fit within support groove 35. Particularly, the ring has thickness 12 that is about the same or smaller than the thickness of a corresponding support groove 35. The term "thickness" can refer to the height of the ring when lying on a flat support surface, such as a table. Thus, the thickness of the ring can be about 50-100% of the thickness of the support groove (e.g., at least/no more than about 50, 55, 60, 65, 70, 75, 80, 85, 90, 95, 99, or 100%). In this way, the ring can snugly fit within groove 35.

The ring further has a height 21 that snugly fits within a corresponding support groove. The term "height" refers to the vertical length when the ring is resting on a horizontal surface (e.g., a table). In some embodiments, the ring height is about the same as the depth of groove 35. However, the ring height is not limited and can be less or greater than the depth of the groove. The ring height can be about 0.1-1 inches (e.g., at least/no more than about 0.1, 0.2, 0.3, 0.4, 0.5, 0.6, 0.7, 0.8, 0.9 or 1 inch). However, the ring height can be greater or less than the disclosed range.

Although depicted as circular in shape, the ring can have any desired configuration. Thus, ring 20 can be circular, oval, square, rectangular, triangular, octagonal, hexagonal, abstract, and the like. It should be appreciated that any shape can be used.

The ring can be constructed from any flexible material. The term "flexible material" refers to a material that allows at least a portion of the ring to be bent or moved without the application of excessive force, and without breaking. Ring 20 can therefore be constructed from any of a wide variety of materials, such as (but not limited to) rubber, plastic, fabric, and the like.

Figure 8C:
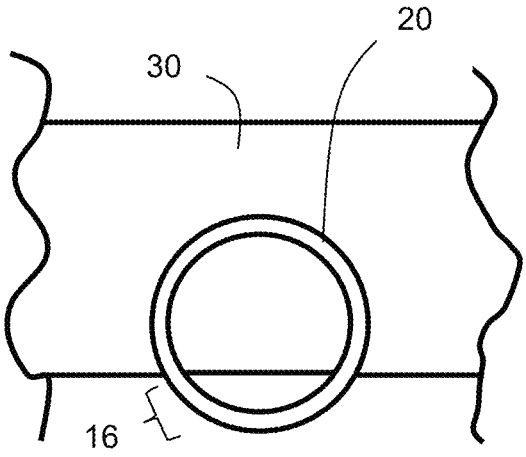
FIG. 8*c* is a bottom plan view of a ring inserted into a support groove in accordance with some embodiments of the presently disclosed subject matter.

Ring 20 is sized and shaped such that a portion fits within support groove 35 positioned on the bottom face of the support, as shown in FIG. 8*c*. The ring can be retained within the groove using any desired mechanism. For example, adhesive can be used. However, any conventional method of retaining the ring within the support groove can be used, such as (but not limited to) the use of magnets, pins, flanges, clasps, fasteners, screws, VELCRO®, and the like.

Figure 8D:
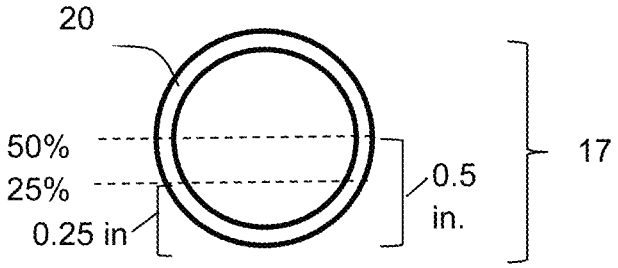
FIG. 8*d* is a top plan view of a ring with the diameter illustrated in accordance with some embodiments of the presently disclosed subject matter.

Ring overhang 16 is external to groove 35 and acts as a stop, preventing the display item from exiting the interior of the frame until desired by the user. The ring overhang can make up about 20-95 (at least/no more than about 20, 25, 30, 35, 40, 45, 50, 55, 60, 65, 70, 75, 80, 85, 90, 95) percent of diameter 17 of the ring, as illustrated in FIG. 8*d*. The term "diameter" refers to the longest distance of the ring that passes through the ring center. Thus, if the diameter of the ring is 1 inch, the ring overhang can have a length of about 0.5 inches (50% of the diameter) or 0.25 inches (25% of the diameter) in two non-limiting examples. The overhang length is the length of the ring that extends outside of the grooves.

Because the ring is constructed from a flexible material, overhang 16 can be bent in a forward or rearward direction in response to the application of force or pressure. In this way, the overhang can be maneuvered out of the way to insert or remove display item 63 (and/or the transparent sheet, matting, backing).

The support and rings can be configured in any desired color(s) (brown, black, green, red, yellow, etc.) and/or patterns (stripes, dots, waves, etc.). The support can further include any desired decorative elements, such as engravings, crystals, jewels, glitter, and the like.

Figure 9A:
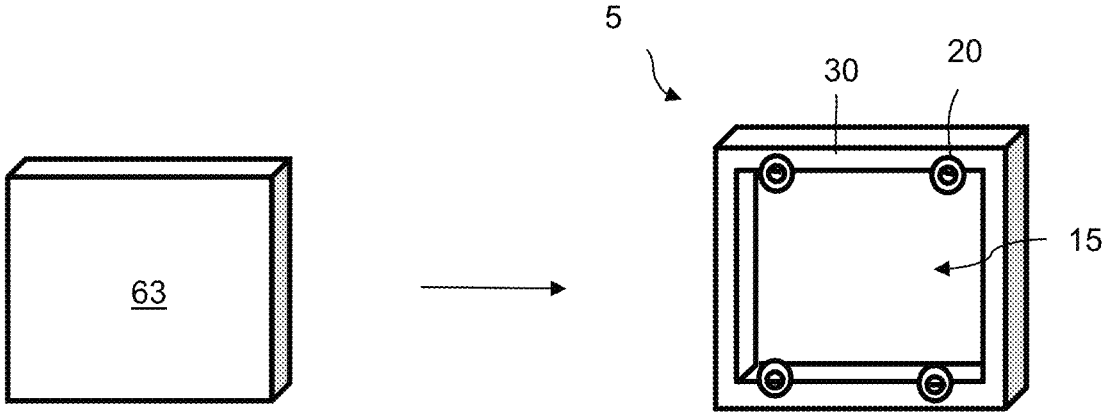
FIGS. 9*a*-9*b* are perspective views of the initial steps of inserting a display into a frame assembly in accordance with some embodiments of the presently disclosed subject matter.
Figure 9B:
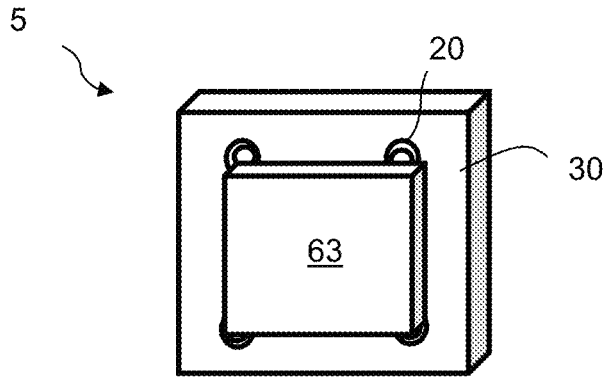
Figure 9C:
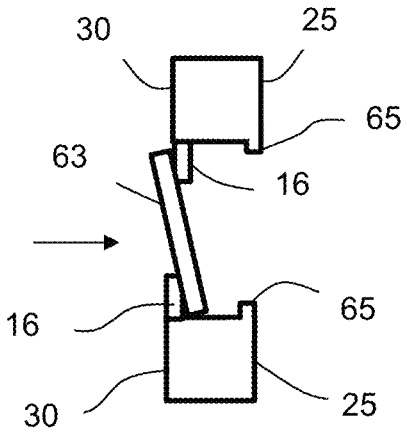
FIGS. 9*c*-9*e* are fragmentary side views illustrating movement of the rings during insertion of a display into a frame assembly in accordance with some embodiments of the presently disclosed subject matter.
Figure 9D:
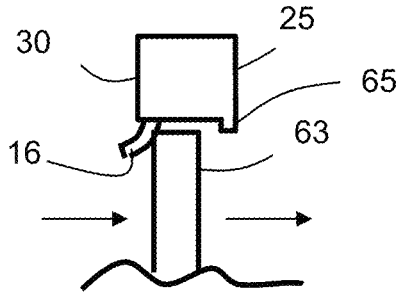
Figure 9E:
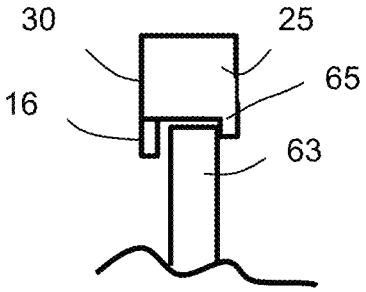

In use, assembly 5 can provide for easy, one-step insertion and removal of display item 63. For example, to insert an item into the assembly for display, it is positioned at rear face 30 of the support, with the viewing side of the display adjacent to rings 20, as shown in FIGS. 9*a* and 9*b*. Display item 63 is then positioned between as many rings 20 and the flange as possible. The reminder of the rings are then rolled past the display item (i.e., bend to accommodate the display item) toward its back side until the display item is released. As a result, the display item is seated into the display assembly, as shown in FIGS. 9*c*-9*e*. In some embodiments, flange 65 helps to ensure that the display item remains housed within the frame assembly by acting as a stop.

Because the ring overhangs are maneuvered out of the way, the display can then be properly positioned adjacent to front face 25 of the assembly. After the display clears the rings, the flexible rings return to their original configuration, as shown in FIG. 9*e*. The display can then be hung or displayed as desired, with rings 20 maintaining the display in position (e.g., so they cannot inadvertently be removed from the frame assembly). In some embodiments, the ring overhangs are flush with the rear side of the display item. Alternatively, backing, matting, and/or a transparent sheet can be used to maintain display item 63 in position.

Figure 10A:
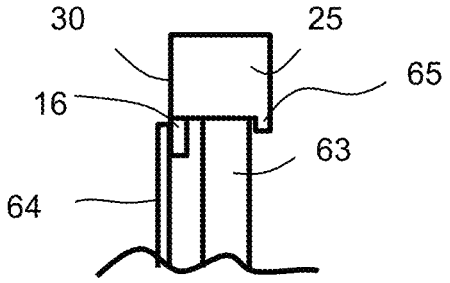
FIGS. 10*a* and 10*b* are fragmentary side plan views illustrating insertion of a backing and other display items in accordance with some embodiments of the presently disclosed subject matter.
Figure 10B:
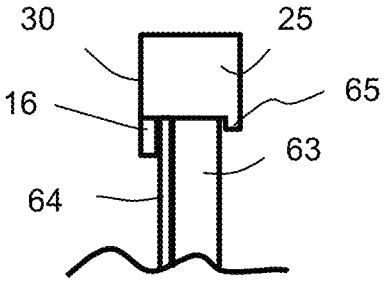

The optional transparent sheet, matting, and backing can be added to the assembly using the same technique. For example, backing 64 can be positioned adjacent to the rear face of the assembly, as illustrated in FIG. 10*a*. Light pressure is then applied, allowing the backing to abut display item 63. As soon as the backing clears the ring overhangs, the rings return to their original position, maintaining the backing and the display in the "use" position, as shown in FIG. 10*b*. The assembly can then be hung. The disclosed frame assembly can therefore be used by a totally unskilled and inexperienced user.

Figure 11A:
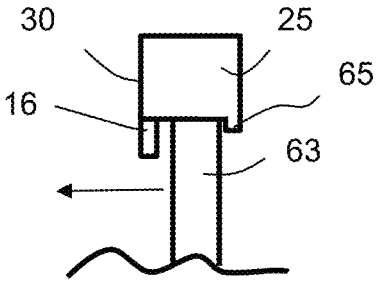
FIGS. 11*a* and 11*b* are fragmentary side plan views illustrating movement of the rings during removal of a display from a frame assembly in accordance with some embodiments of the presently disclosed subject matter.
Figure 11B:
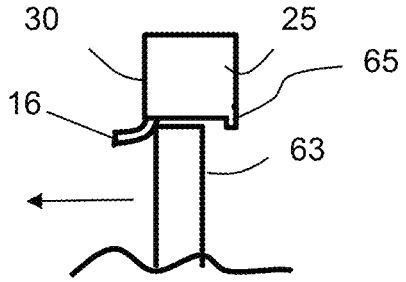

When a user desires to remove backing 64 and/or display 63, the steps above are simply reversed. Specifically, light pressure is applied to the backing or display from the front side, pushing the item(s) towards rings 20, as shown in FIG. 11*a*. As a result of the pressure, ring overhang 16 bends in an outward direction (e.g., away from the assembly) to allow the display to be removed, as shown in FIG. 11*b*. After removal of the display item, the rings return to their original configuration. The frame can then be easily reused by inserting a new display element as described above.

The disclosed frame assembly offers many advantages over prior art framing systems. For example, the disclosed assembly requires no external hardware (such as metal tabs, screws, nails, and the like). Rather, the flexible ring overhangs move into and out of position to allow a user to quickly insert and remove a display item. The assembly can therefore be assembled and disassembled by hand without using any tools.

Because the disclosed assembly lacks external hardware, the assembly can be hung on walls without leaving an unsightly scratch or black mark.

Assembly 5 is easy to use, requiring only the application of light pressure. As such, the system can be enjoyed by a variety of users, including children, the elderly, and the handicapped.

Due to the ease of use, users can change the display items whenever desired. For example, children's artwork can be periodically updated. In addition, the assembly can allow users to change the display seasonally (Easter, Christmas, Valentine's Day, etc.).

Assembly 5 can be inexpensively manufactured, using conventional materials.

The disclosed assembly is also aesthetically pleasing, providing an attractive way to display works of art and other similar materials.

In some embodiments, assembly 5 can be used either horizontally or vertically, providing multiple ways to hang and enjoy the display item.

The disclosed ring structure allows items to be inserted or removed, and also acts as a fastener to maintain the display item in a proper position while being used.

Because rings 20 are flexible, they do not damage the display item in any way during addition, removal, or use.

The foregoing descriptions have been presented for purposes of illustration and description and are not intended to be exhaustive or to limit the presently disclosed subject matter. Many modifications and variations are possible in light of the present disclosure.

What is claimed is:

1. A framing assembly comprising:

a support defined by a front face defined as a front horizontal surface, an opposed rear face defined as a back horizontal surface, and one or more sidewalls joined together to form a support body comprising a central opening; wherein the rear face comprises one or more partial ring-shaped grooves cut into the back horizontal surface;

one or more flexible rings, wherein each ring is sized and shaped to be partially housed within a corresponding groove positioned in the rear face of the support;

wherein when each ring is partially housed within the corresponding groove on the rear face of the support, a ring overhang extends adjacent to the central opening.

2. The framing assembly of claim 1, further comprising a transparent sheet, a rear backing, a matting, or combinations thereof.

3. The framing assembly of claim 1, wherein 20-95 percent of the total volume of each ring is housed within a corresponding groove.

4. The framing assembly of claim 1, wherein the grooves have a depth of 0.01-0.5 inches.

5. The framing assembly of claim 4, wherein the depth of each groove is greater than or equal to the height of a corresponding ring.

6. The framing assembly of claim 1, comprising 1-10 grooves and 1-10 rings.

7. The framing assembly of claim 1, wherein the support has a length, width, or both of 4-50 inches.

8. The frame assembly of claim 1, further comprising an interior flange positioned about the perimeter of the central opening.

9. The frame assembly of claim 1, wherein the rings are constructed from rubber, plastic, or combinations thereof.

10. The frame assembly of claim 1, wherein the support is constructed from wood, plastic, metal, stone, ceramic, or combinations thereof.

11. A method of inserting a display item into a frame assembly, the method comprising:

positioning the display item adjacent to a rear face of a frame assembly support such that the display item abuts a plurality of ring overhangs in a first position, wherein the frame assembly comprises:

a support defined by a front face defined as a front horizontal surface, the rear face defined as a back horizontal surface, and one or more sidewalls joined together to form a support body defined by a central opening; wherein the rear face comprises one one or more partial ring-shaped grooves cut into the back horizontal surface;

a plurality of flexible rings, wherein each ring is partially housed within a corresponding groove in the rear face of the support and the plurality of ring overhangs extend adjacent to the central opening;

positioning one or more edges of the display item between the one or more flexible rings and the front face of the frame assembly;

rolling any remaining rings of the plurality of flexible rings passed the display item, toward the rear face of the frame assembly to seat the display item between the front and rear faces of the support, whereby the display item is inserted into or removed from the frame assembly.

12. The method of claim 11, wherein the rings are configured to bend 45-90 degrees from the first position to a second position.

13. The method of claim 11, further comprising adding a backing, matting, transparent sheet, or combinations thereof.

14. The method of claim 11, wherein the display item rests against a frame flange after being inserted into the frame assembly.

15. The method of claim 11, wherein the grooves have a depth of 0.01-0.5 inches.

16. The method of claim 11, wherein the depth of each groove is greater than or equal to the thickness of a corresponding ring.

17. The method of claim 11, wherein the assembly comprises 1-10 grooves and 1-10 rings.

18. The method of claim 11, wherein the support has a length, width, or both of 4-50 inches.

19. The method of claim 11, wherein the display item is selected from an art print, art canvas, drawing, print, poster, photograph, card, diploma, mirror, certificate, tapestry, or combinations thereof.

20. The framing assembly of claim 1, wherein each flexible ring includes an open central portion.

* * * * *